United States Patent [19]

Latto

[11] Patent Number: 5,052,813

[45] Date of Patent: Oct. 1, 1991

[54] TUBE TYPE VORTEX RING MIXERS

[76] Inventor: Brian Latto, R.R. #2, 153 Valley Road, Dundas, Ontario, Canada, L9H 5E2

[21] Appl. No.: 495,677

[22] Filed: Mar. 19, 1990

Related U.S. Application Data

[63] Continuation-in-part of Ser. No. 268,799, Nov. 8, 1988, abandoned.

[51] Int. Cl.[5] ..... B01F 13/02

[52] U.S. Cl. ..... 366/348; 366/101; 366/267; 366/275; 366/349

[58] Field of Search ..... 366/262, 267, 348, 349, 366/101, 106, 107, 332, 150, 275; 75/583

[56] References Cited

U.S. PATENT DOCUMENTS

| | | | |
|---|---|---|---|
| 694,210 | 2/1902 | Soellner | 366/269 |
| 1,588,693 | 6/1926 | Blum | 366/131 |
| 2,615,692 | 10/1952 | Muller | 366/332 |
| 2,935,840 | 5/1960 | Schoppe | 366/165 |
| 3,398,935 | 8/1968 | Livesey | 366/275 |
| 3,712,591 | 1/1973 | Booth | 366/275 |
| 4,008,884 | 2/1977 | Fitzpatrick | 366/233 |
| 4,044,079 | 8/1977 | Tveit | 366/262 |
| 4,449,827 | 5/1984 | Karkiewicz | 366/275 |
| 4,452,634 | 6/1984 | Oguchi | 75/583 |

*Primary Examiner*—Robert W. Jenkins

*Attorney, Agent, or Firm*—Moss, Barrigar & Oyen

[57] ABSTRACT

A method and apparatus is disclosed for mixing or agitating fluids using vortex rings in which a tube of inside diameter d is inserted into the fluid with an open end in the fluid. Fluid is drawn into the tube, and a slug of fluid is propelled a distance L down and out of the tube to create a vortex ring at the exit of the tube for propagation through the fluid. The ratio of L/d is between 0.8 and 3.8. The propelling means preferably involves a pulser cylinder communicating with the tube and a piston positioned in the pulser cylinder for reciprocating motion towards and away from the fluid to be mixed or agitated, or a bellows serving a similar function. The propelling means provides a generally square wave pressure impulse to the fluid to eject it from the tube in the form of a vortex ring.

18 Claims, 10 Drawing Sheets

TUBE TYPE VORTEX RING MIXERS

REFERENCE TO RELATED APPLICATIONS

This is a Continuation-In-Part application of Ser. No. 07/268,799 filed Nov. 8, 1988, now abandoned.

BACKGROUND OF THE INVENTION

This invention relates to tube-type vortex ring mixing and/or agitating apparatus and methods for use with fluids. The apparatus and methods can also be used for the efficient addition of solids or liquids to a fluid during a mixing and/or agitation process.

The concept of vortex rings in fluids has been known for many decades. Vortex rings can occur naturally and can be created in various ways such as mechanically by the impulsive ejection of a slug of fluid from an orifice. Some examples of vortex rings are gas or smoke rings, and the smoke and/or gas rising from an explosion, such as an atomic explosion. A vortex ring can be generated by many simple devices e.g. from a tube or an orifice, by impulsively blowing into one end of a straw immersed in a liquid or when an immersed jet is started. Although a vortex ring can be produced relatively easily, there are particular criteria which absolutely must be followed if energetic vortex rings which will travel relatively long distances before their self destruction are to be generated efficiently. The design and operating criteria of the equipment to produce and propagate vortex rings is therefore very important, if the rings are to be produced efficiently for mixing or agitation purposes.

There appear to be no suggestions of the use of ring vortices for the specific application of the mixing or agitation of fluids in enclosed boundaries, such as mixing vessels and tanks, with the exception of copending U. S. Pat. application No. 369,802 filed June 22, 1989 by the present inventor.

U.S. Pat. No. 4,452,634 (Oguchi et al) does describe some very simple equipment which uses pulsed flow from a tube immersed in liquid steel for mixing the steel, but there is no reference to vortex ring generation. The obvious difficulty when pulsing the liquid in a large diameter tube with direct gas/liquid interface and gas as the transfer media, is that large volumes of gas are required to drive the unit resulting in slow pulsing and considerable waste of energy during the compression and expansion process. It also results in poorly sustained immersed liquid jets which produce local mixing in the vicinity of the orifice or jet, but are quite poor mixing processes for the entire volume of liquid to be mixed.

SUMMARY OF THE INVENTION

The present invention produces efficient and energetic vortex rings which in turn mix, agitate, or aerate a fluid, and apparatus which can be used efficiently to introduce materials into the fluid during the mixing or agitation process.

Thus, in accordance with the present invention there is provided apparatus for mixing or agitating fluids, comprising a tube of inside diameter d having an open end, the tube being adapted to be inserted into a fluid to be mixed with the open end in the fluid. Means are provided for inserting fluid into the tube. Means are also provided for propelling a slug of fluid out of the tube, the fluid being propelled a distance L along the tube; wherein the ratio of L/d is between 0.8 and 3.8, thereby creating a vortex ring at the open end of the tube for propagation through the fluid.

In accordance with another aspect of the invention, there is provided a method of mixing a fluid comprising the introduction of a tube of inside diameter d into the fluid, the tube having an open end located in the fluid. Fluid is inserted into the tube and then forced to travel a distance L through the tube and out of the open end. The ratio of L/d is between 0.8 and 3.8.

BRIEF DESCRIPTION OF THE DRAWINGS

In order that the invention may be more clearly understood, the preferred embodiments thereof will now be described in detail by way of example, with reference to the accompanying drawings, in which.

DETAILED DESCRIPTION OF THE PREFERRED EMBODIMENTS

The mixer or agitator of the present invention utilizes vortex ring generation and propagation for the mixing or agitation of fluids and will be described as a tube-type vortex ring mixer or agitator. It can also be used to add gases into the fluids or aerate fluids which are being mixed or agitated.

Figure 1:
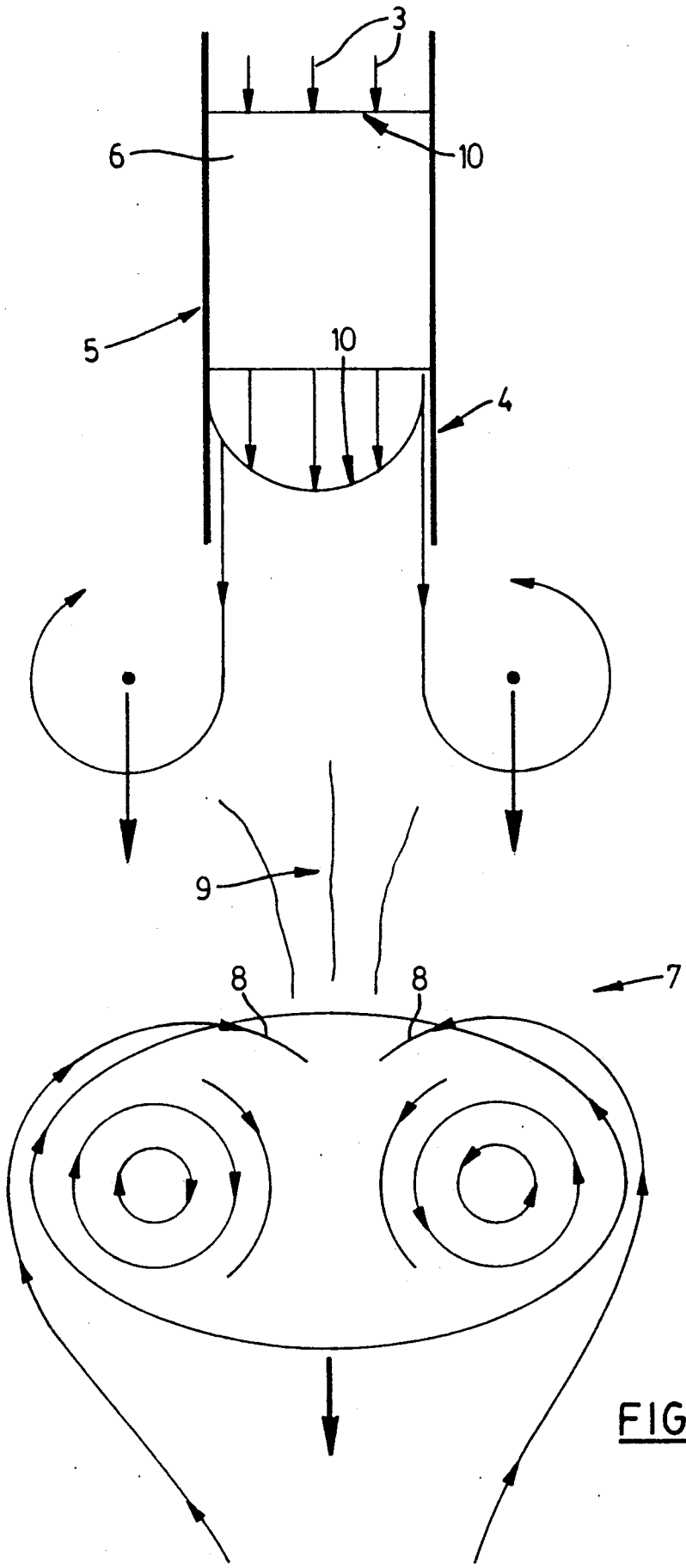
FIG. 1 is a diagrammatic view illustrating the formation of a vortex ring at the open end of a tube-type vortex ring generator.
Figure 2:
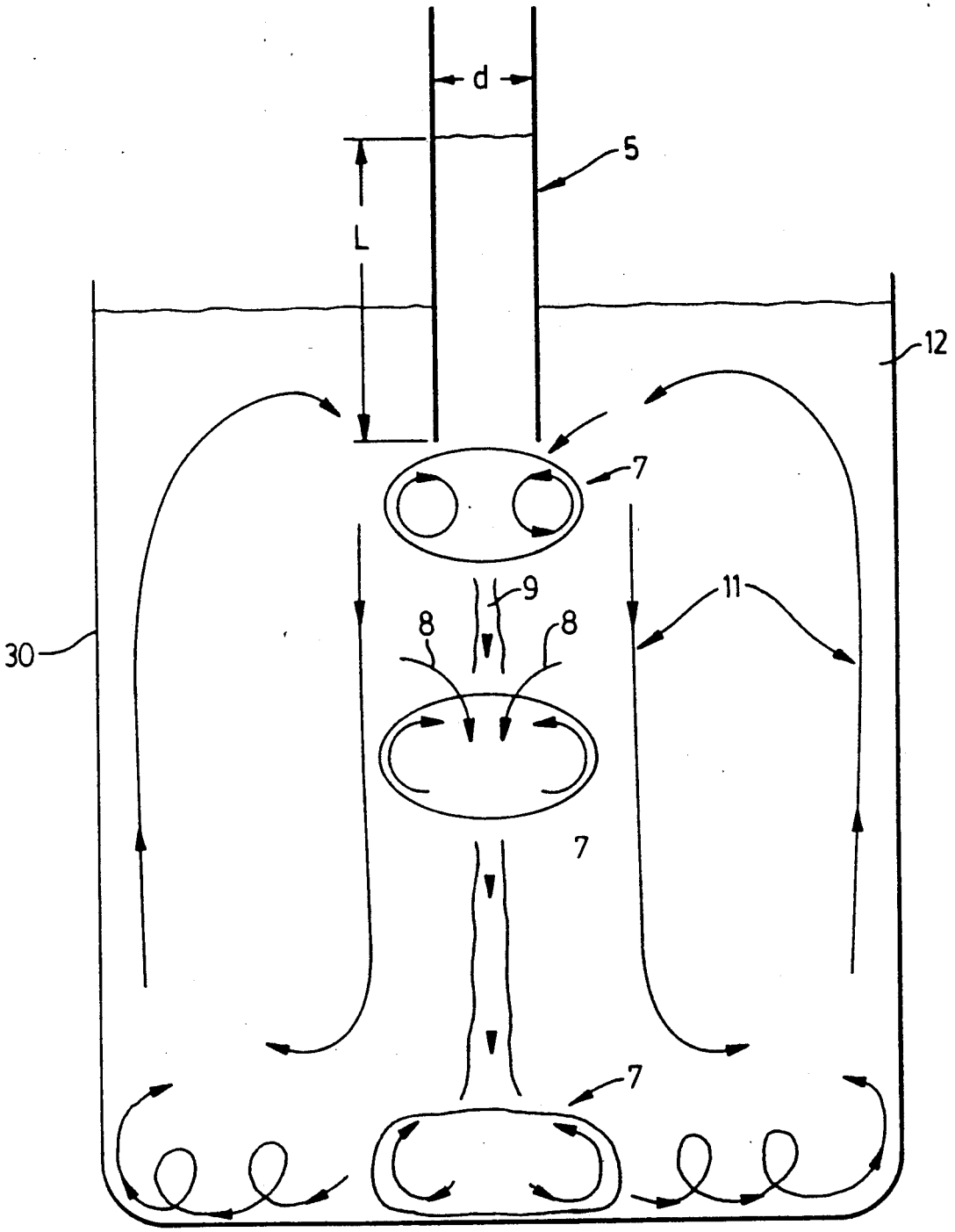
FIG. 2 is a diagrammatic view of the flow patterns created in a mixing tank by the generation of vortex rings.

Referring firstly to FIGS. 1 and 2 the formation and propagation of a vortex ring 7 is illustrated. When a pressure impulse is applied to a slug of fluid 6 in a tube 5, as indicated by arrows 3, the slug of fluid 6 is ejected from the tube to generate a vortex ring 7 which can travel to distant locations or regions in the fluid media in which tube 5 is immersed. The generated vortex ring 7 in effect rolls through the encompassing fluid, since the fluid adjacent to the side boundaries or surfaces of the vortex ring has a velocity relative to the vortex ring approaching zero. Therefore, the local peripheral shear stress which creates viscous drag on the vortex ring is very low. This makes the progress of the vortex ring through the fluid virtually unhindered and relatively insensitive to the viscosity of the fluid involved.

During the transport of the vortex ring, there is some induction of fluid 8 into the ring from the surrounding fluid. This results in a change in the concentration of the fluid in the vortex ring. There is however, some rejection of fluid from the ring as it translates through the surrounding fluid as well, which results in a mixed fluid trail or wake 9 behind the ring.

FIG. 2 shows vortex ring 7 in three different positions as it progresses downwardly through the liquid 12 in tank 30. The bulk mass transfer, the motion, and the trail created behind the ring, created by the translation of the vortex ring, results in a global mass transport and fluid circulation and an overall mixing pattern 11 in the bulk of the fluid. That is, a relatively large quantity of fluid is transferred from tube 5 through the fluid to the bottom of tank 30 and up along the sides of the tank, while some mixing occurs in the trail of the vortex ring. These mechanisms combine to create a very efficient mixing or agitation process.

Vortex rings 7 can be projected distances of over one hundred times the diameter of the generating tube open end or orifice, which can therefore mean considerable distances for large orifices. The volume of liquid projected depends on the velocity and the form of the impulse to the fluid, which should approximate a square wave, and the ratio L/d where L is the distance along the tube that the fluid in the tube travels, and where d is the inside diameter of the tube. The optimum value for L/d is approximately 2.8, but this ratio can vary between 0.8 and 3.8 and still produce effective results. As the L/d ratio decreases, the vortex ring initially generated is smaller than optimum, and although this ring grows, it cannot reach its optimum size resulting in a lower volume than optimal value, and therefore a lower efficiency of mass transfer and mixing time. As the L/d ratio increases beyond 2.8 a vortex ring is generated and leaves the tube end, but before the ejection process is complete, one or more successive rings may be created which are unstable and interact with the others and result in poor propagation and/or early destruction. When L/d is 2.8 the vortex ring has an optimal and stable initial diameter and volume which does not appreciably change after formation.

As mentioned above, the impulse to the fluid in the tube should be as close as possible to a square wave form and in some cases non-symmetrical. That is, high initial pressure and velocity to eject the fluid, with this pressure remaining constant until the fluid is ejected, and then a rapid drop in pressure. A sinusoidal pressure gradient will not produce stable vortex rings, but merely jets of fluid emerging from the tube. Such jets cannot penetrate the fluid, especially if the fluid is stratified or has high viscosity.

In the vortex ring mixers of the present invention, operating frequencies between 0.25 and 5 Hz can be used. For materials which quickly sediment high frequencies are recommended. However, if it is required to project vortex rings large distances, lower frequencies are often more desirable. A high frequency can be used initially to do the initial mixing and then the frequency can be lowered to keep the fluid in the desired condition.

Figure 3:
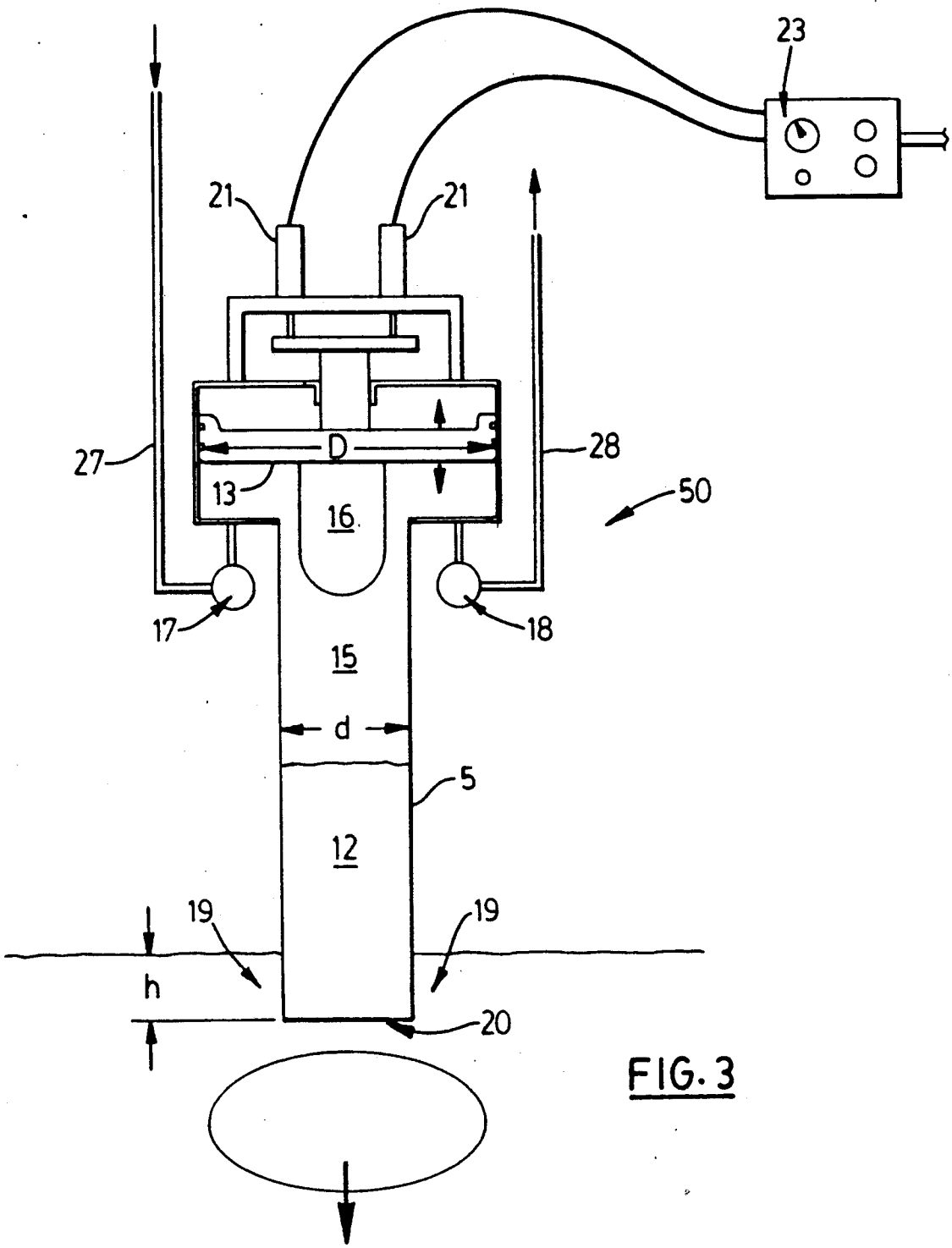
FIG. 3 is a diagram of a vortex ring mixer or generator tube having a piston type pulser unit.

Referring next to FIG. 3, a preferred embodiment of a vortex ring mixer or agitator is generally indicated by reference numeral 50. Mixer 50 includes a generator tube 5 into which the liquid 12 to be mixed or agitated is drawn. Generator tube 5 is shown in a vertical orientation, but it could be positioned at any desirable angle for a particular application. A pulser piston 13 located in a pulser cylinder 14 is used to create a low pressure in chamber 15 above the liquid when piston 13 is moved away from the liquid. An optional removable cylindrical boss 16 formed centrally on pulser piston 13, reduces the volume of chamber 15, and also reduces the possibility of splashing of material into the pulse cylinder. That is, boss 16 reduces the volume of cushion gas above liquid 12 and thus results in either a reduced pulser piston stroke or permits the use of a longer generator tube.

The longer the generator tube length the higher the pulser cylinder is located above the surface of the liquid being mixed or agitated, which together with the boss greatly reduces the possibility of the liquid being mixed or agitated splashing up into the pulser cylinder. Also, if the length of the boss is such that its end is always in the generator tube, it greatly reduces the chance of the material being mixed or agitated into the pulser cylinder.

When liquid 12 is a material which is easily oxidized or contaminated by oxygen or air, i.e., where the process needs to be anaerobic, the gas in the pulser chamber 15 would be any suitable gas other than air or oxygen, such as argon or nitrogen, or even methane or carbon dioxide in the case of waste water treatment digesters. This intermediate or cushion gas acts as a transfer media, transferring the force or suction of the pulser piston to the actual fluid 12 to be mixed or agitated. This gas may require replenishment where small quantities are absorbed by the fluid being mixed or agitated or where there is leakage. This is achieved by a pipeline 27, and non-return check valve 17. The gas can be supplied from a gas bottle or supply line or in the case of digesters, from the gas above the fluid being mixed or agitated. The valve is set to remain closed, so that the negative pressure in chamber 15 is sufficient to lift the fluid being mixed or agitated to the required height for the correct generation of a vortex ring. This value of the negative gas pressure will depend on the density of the fluid being mixed or agitated and the operating criteria.

A second pipeline 28 having a non-return check valve 18 is also connected to the pulser cylinder to permit discharge of the cushion gas if the pressure inside the cylinder exceeds a design value. This avoids the expelling of gas with the vortex ring when straightforward mixing or agitating processes are required. However, if aeration or gasification of the fluid is required, then the operating maximum cushion gas pressure will be sufficient to expel cushion gas from the open end 20 of tube 5. In some cases, such as for molten metal, such as steel, some degassing of the metal or liquid being mixed or agitated may occur due to the minimum pressure being less then the local ambient pressure. Consequently, there can be a build up of the cushion gas in chamber 15. Valve 18 permits a discharge of this excess gas.

A higher cushion gas pressure in chamber 15 results in a more efficient operation of the mixer because a smaller piston stroke is required and less energy is absorbed by the gas. The depth of immersion 'h' of the generator 5 into the fluid being mixed can also be increased as the maximum cushion gas pressure increases. In many cases it is not desirable to have anything but the minimum depth of immersion, i.e. just the depth required to avoid the entry of the atmosphere into tube open end 20, because there is only limited agitation or mixing of the fluid in the region 19 immediately behind open end 20.

The diameter D of pulser piston 13 can be the same as the diameter 'd' of generator tube 5, but normally should be appreciably larger. This is particularly desirable if the mixer unit is to operate at relatively high frequencies (e.g. of the order of 2 to 5 Hz or higher) and high pulser velocities, which are desirable for the efficient generation of energetic vortex rings and the subsequent efficient mixing or agitating of the fluid. This will be discussed further below.

Pulser piston 13 is normally driven by one or more relatively small pneumatic actuators or cylinders. 21. The compressed gas supply to the cylinders 21 is controlled either by a fully pneumatic control circuit, or by an electro-pneumatic circuit 23, or by an electro-mechanical drive. A suitable mechanical drive could also be used,such as a cam and cam follower. This circuit 23 can control the stroke of cylinders 21 in both directions and therefore the stroke of pulser piston 13, and thus control the form of the operating cycle and frequency of operation of the pulser piston. The form of the operating cycle is quite important for optimum performance, and can be different for various fluids and systems. Control circuit 23 is programmable, so that it can continuously vary the frequency of operation of piston 13, or it can have a programmed cycle of operation, such as initially a high frequency operation for a given time followed by a continuous reduced frequency. This is particularly useful for situations where the liquid initially needs to be vigorously agitated, which may be followed by gentle agitation. This arrangement permits considerable energy savings. The fully pneumatic control circuit is more suitable for potentially explosive environments.

The particular design described here, of a pulser piston which is appreciably larger in diameter than that of the generator tube, with a relatively small cushion gas volume, and relatively small drive cylinders to drive the pulser piston, results in a very low compressed gas consumption per unit mass of the fluid being mixed or agitated, especially when compared with standard pneumatically driven rotary mixers, and results in very short mixing times. Due to the minimized size of the components and low compressed gas consumption with this type of mixer, it is also possible to operate the unit at relatively high frequencies.

Figure 4:
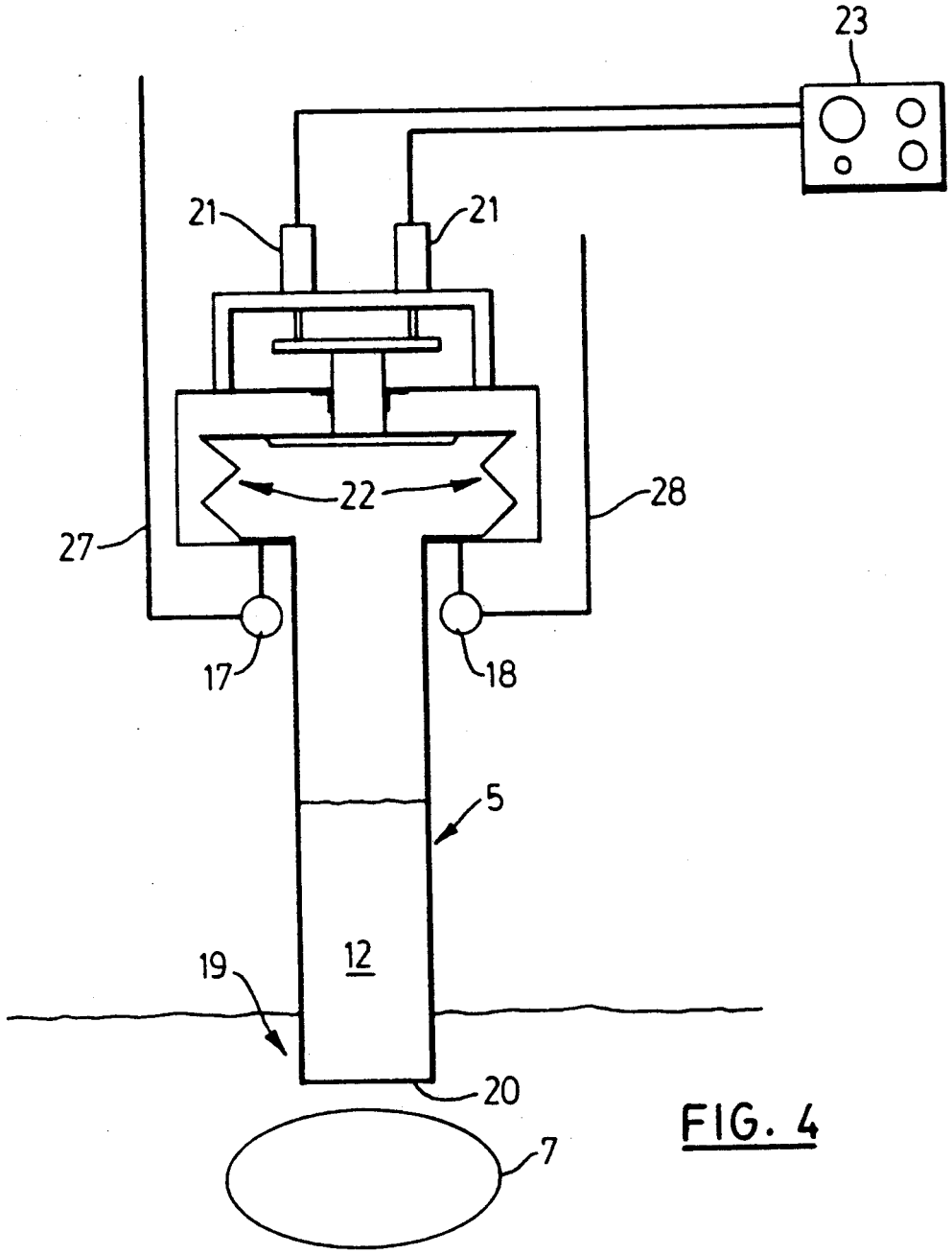
FIG. 4 is a diagram of a vortex ring mixer having a bellows type pulser unit.

Referring next to FIG. 4, an alternative embodiment is shown having a flexible bellows 22. Bellows 22 is made of material compatible with the liquid to be mixed. The bellows arrangement isolates the materials being agitated/mixed, and is therefore very suitable for mixing noxious or contagious liquids, such as for sewage digesters. The bellows applies suction to draw fluid into the tube and then pressure to eject the fluid from the tube. This arrangement permits the use of simple disposable units which avoids the need for cleaning, such as for paints, sewage or bacterial systems.

If the fluid to be mixed will not damage the pulser cylinder of the FIG. 3 embodiment or the bellows of the FIG. 4 embodiment, then the cushion gas can be dispensed with and the pulser cylinder or piston and the bellows can be in direct contact with the liquid to be mixed or agitated.

Figure 5:
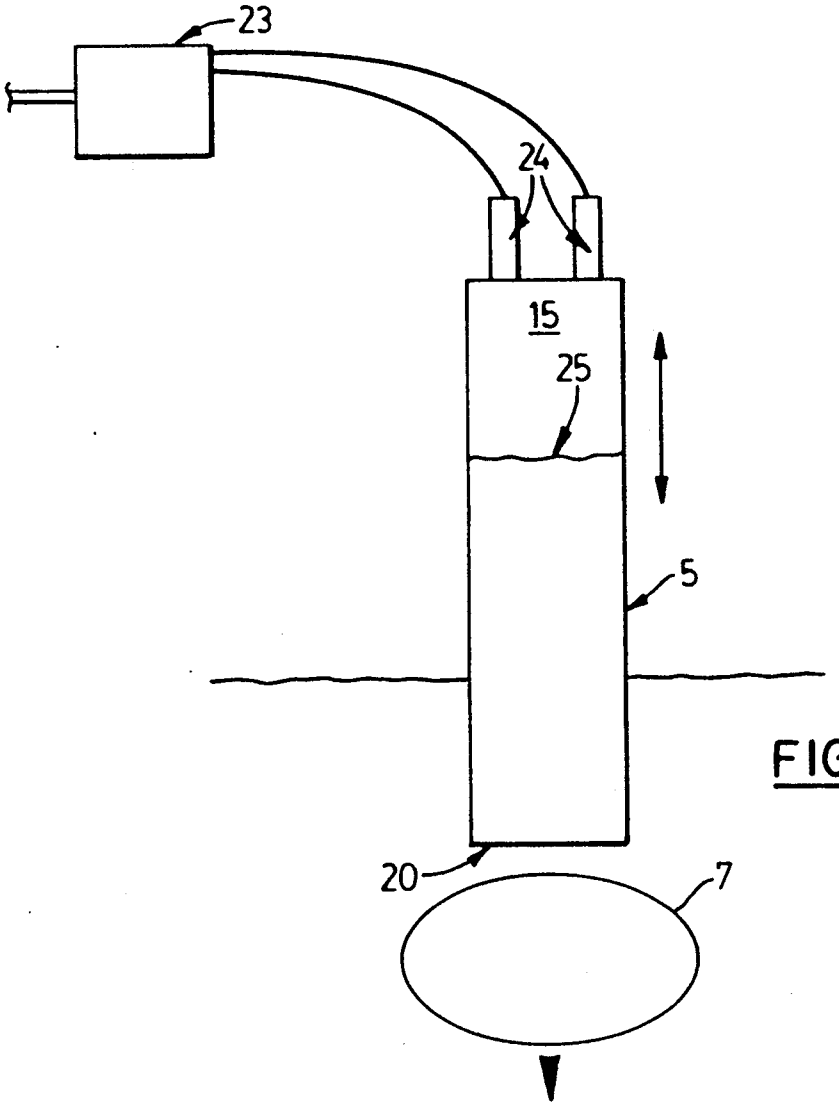
FIG. 5 is a diagram of a vortex ring mixer which utilizes the movement of a tube to generate vortex rings.

Referring next to FIG. 5, another embodiment of a mixer is shown in which the generator tube 5 is raised and lowered in a vertical motion in the liquid to be mixed or agitated. A valve arrangement 24 mounted on top of generator tube 5 which is controlled by a control circuit 23, to permit the liquid to be raised and lowered in the generator tube.

The generator tube 5 is driven downwards into the liquid by either a motor or pneumatically driven cylinders (not shown), with one of the control valves 24 open. The trapped gas above the liquid in the generator tube 5 is thus allowed to escape from the tube either to a storage reservoir or to the atmosphere. The liquid will then in effect rise in the generator tube 5 to the level of the liquid in the mixing vessel or thereabouts depending on the density of the liquid in the generator tube. The valves are then closed and the generator tube is withdrawn (raised) from the liquid without the open end 20 of the generator tube actually leaving the liquid surface. This reduces the pressure in the tube to below ambient pressure to draw in or keep the fluid in the tube. The liquid level 25 in the generator tube rises with the tube 5 (but not necessarily the amount that the tube is withdrawn from the liquid due to the expansion of the gas in the space 15 above the liquid in the tube).

After the tube is raised to its desired height, which is dictated by the required height of the liquid in the tube relative to the tube exit diameter as discussed above, the other valve 24 is opened and either a controlled volume of compressed gas is quickly injected into the space 15 above the liquid, or atmospheric air is allowed to rapidly flow into the space via the valve. When the correct liquid height to tube diameter (L/d) ratio is used, the result is the rapid descent and ejection of a slug of liquid from the generator tube which will in turn result in the creation of the desired vortex ring at the generator tube exit. It will be appreciated that a single two-way valve 24 could be used in place of the two valves shown in FIG. 5.

Figure 6:
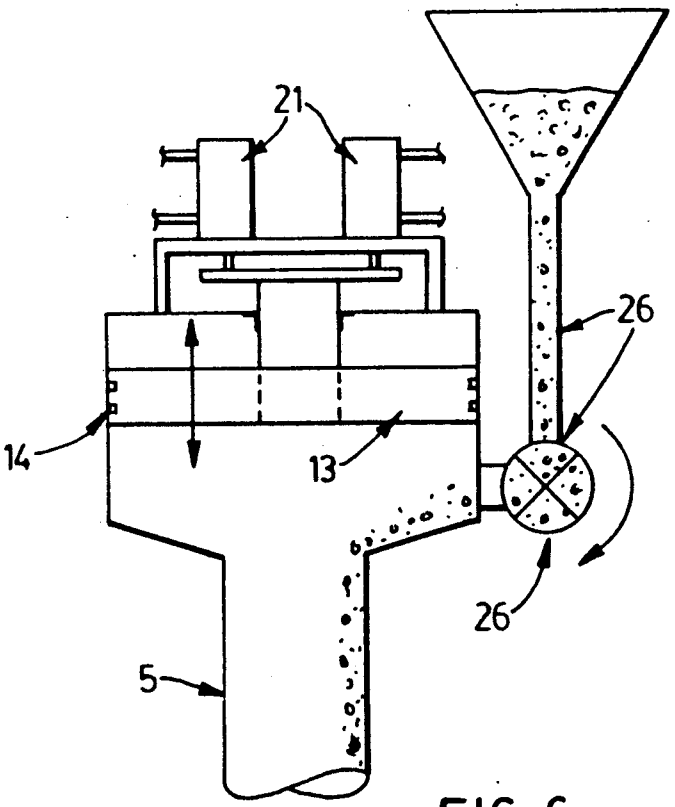
FIG. 6 is a diagram of a vortex ring mixer showing the arrangement for the feeding of an additive.

Referring next to FIG. 6, an embodiment similar to the FIG. 3 embodiment is shown which additionally includes a device 26 located on the side of the pulser cylinder 14 for adding a liquid or particulate solid material to the fluid to be mixed. It will be appreciated that other ways could be used to introduce this material into tube 5 as well, for example, through piston 13 with appropriate valving. Whichever way is used, the liquid or solid will pass into the generator tube and will be thus ejected with the vortex ring. This is a particularly efficient method of introducing materials or liquids having a density which is different from that of the bulk of the liquid being mixed or agitated or where the materials may react with the fluid being mixed. If the feeder mechanism is synchronized with the pulser mechanism, the material to be added is ejected with and held within the vortex ring to travel with the vortex ring to the bottom of the tank of fluid being mixed. Therefore, the residence time in the fluid (and therefore the reaction time) will be much greater than for conventional mixing methods. The material injected in this manner will be forcibly and efficiently dispersed throughout the bulk of the fluid.

Figure 7:
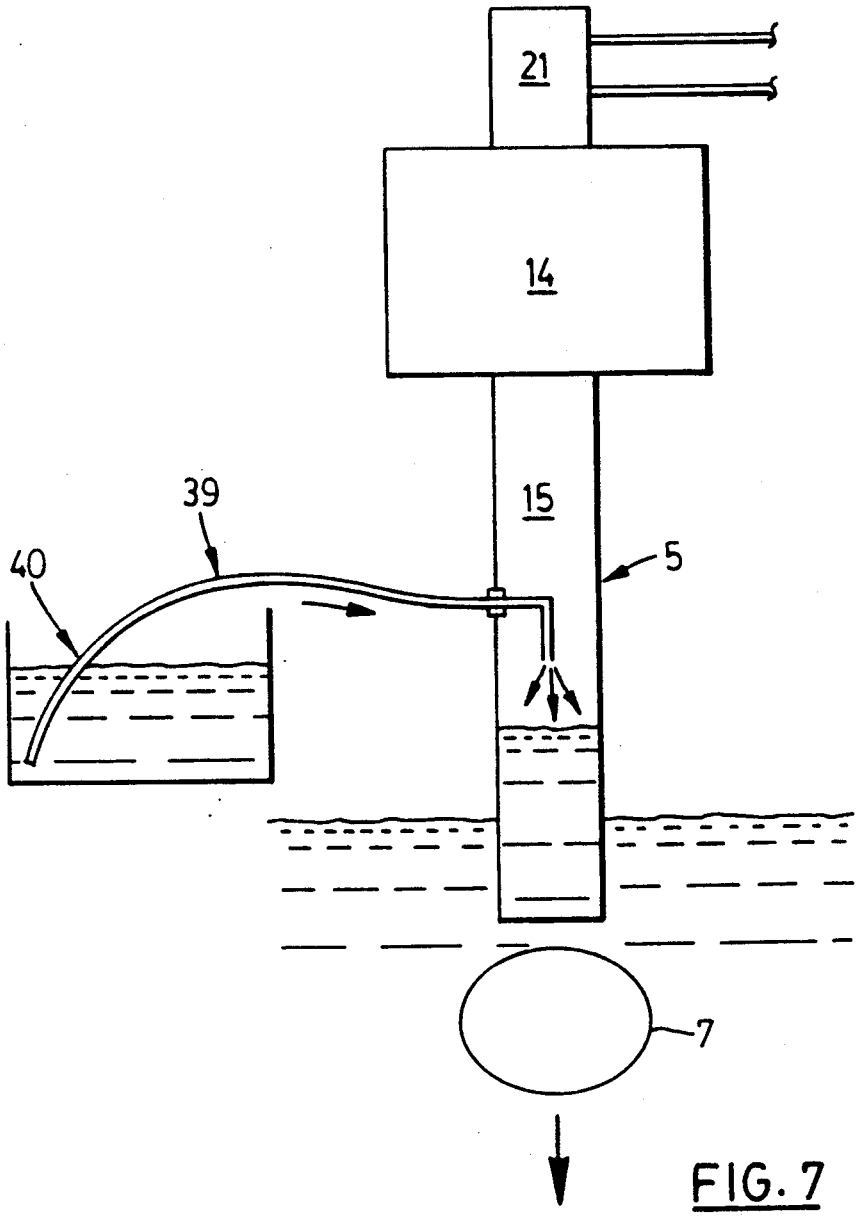
FIG. 7 is a diagram of a vortex ring mixer with an alternative method of mixing an additive into the fluid.

FIG. 7 shows another embodiment of a vortex ring mixer which is convenient for adding liquid to the fluid being mixed, especially if the liquid additive has a density less than that of the bulk of the fluid and has to be dispersed in the bulk of the fluid being mixed or agitated. An example of this application is where oil is being added to water for spray quenching processes in the steel industry. The liquid to be added to the bulk of the fluid being mixed is injected via a tube 39 (as a result of the negative pressure in chamber 15). The liquid additive can either be inserted into a liquid additive storage reservoir 40 in communication with tube 39, or be pumped through tube 39 by a simple pump (not shown). This general arrangement will in many cases create quite small droplets of the liquid being added, such as oil, during the violent agitation created in the generator tube. The resulting emulsion is then ejected from the generator tube as vortex rings.

Figure 8:
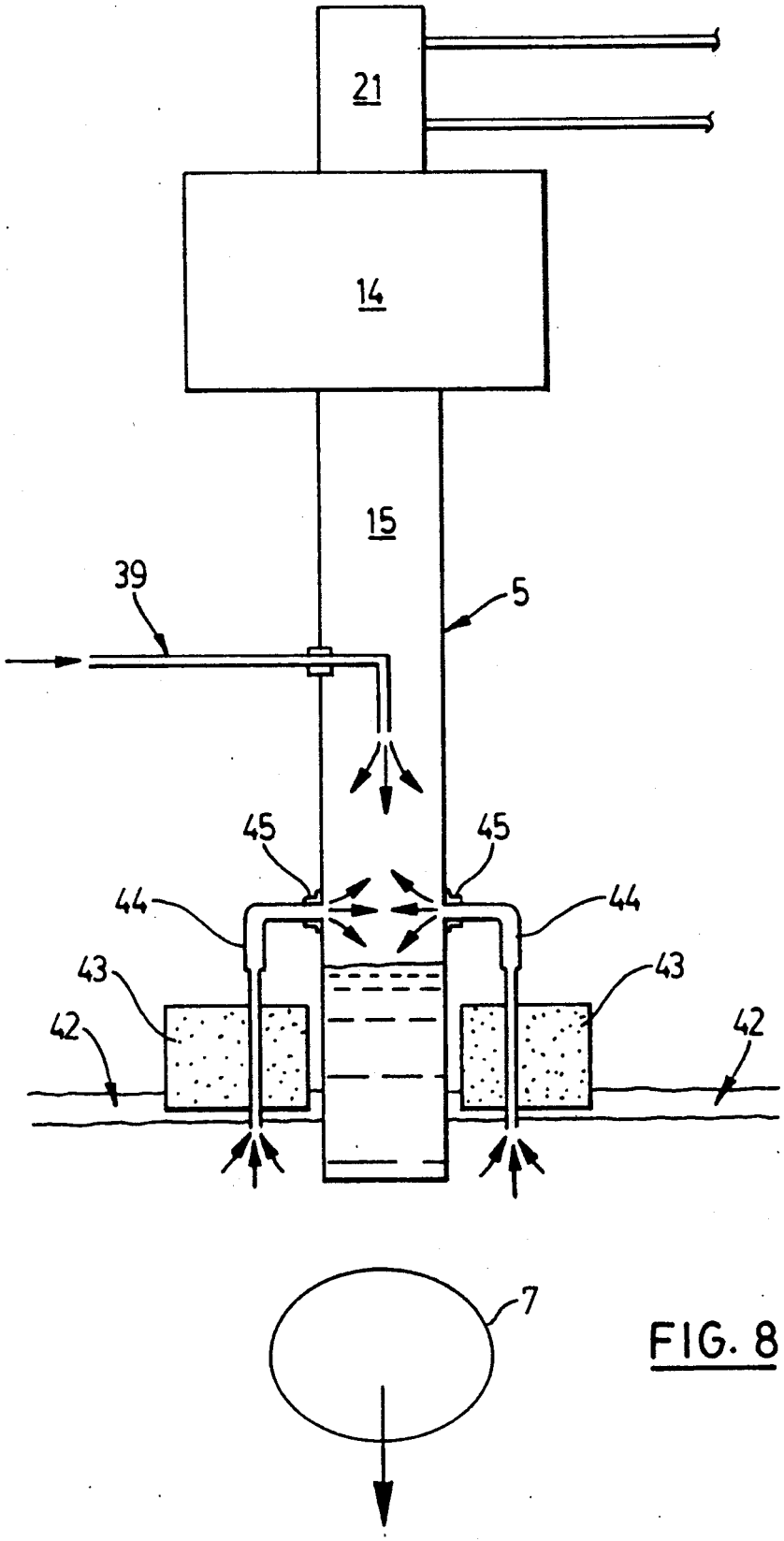
FIG. 8 is a diagram of a vortex ring mixer which has both means for mixing an additive into the fluid and a floating self-activating surface skimmer system.

An alternative arrangement as shown in FIG. 8 can be used to recirculate a floating surface layer of liquid 42. A floating collar 43 (skimmer) has tubes 44 passing vertically therethrough to injection ports 45 in the wall of the generator tube 5. When the pulser piston retracts (is raised) there is a pressure drop in the fluid in the generator tube. This drop in pressure will suck the floating liquid from the surface into the generator tube. This method has proven to be very effective for the addition of oil to water with only minimal use of dispersants.

Figure 9:
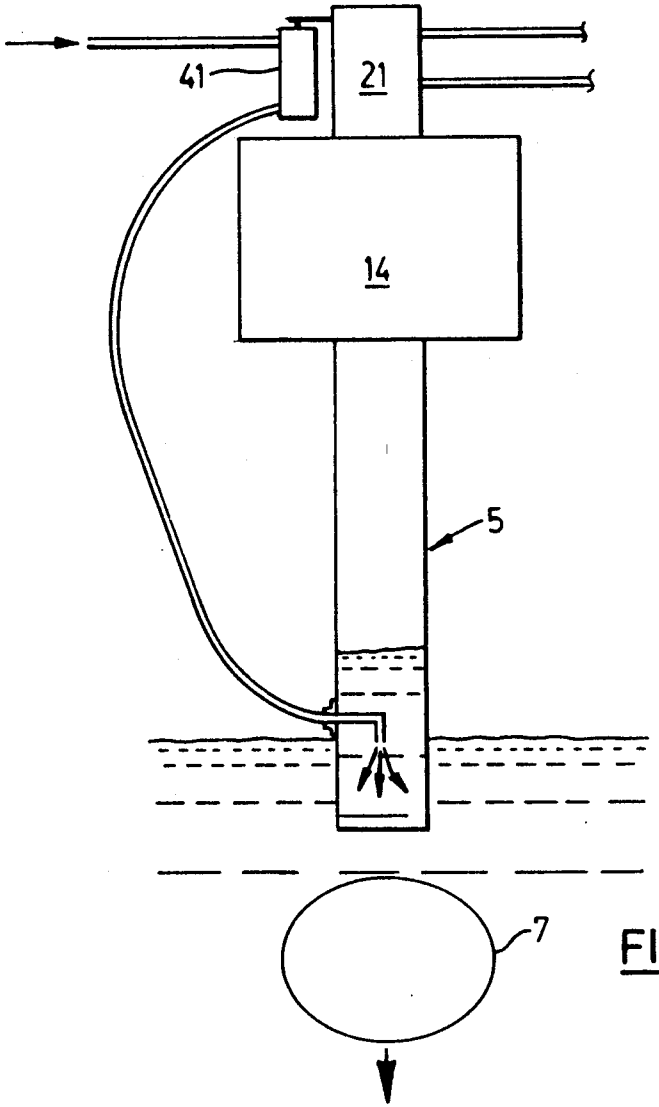
FIG. 9 is a diagram of a vortex ring mixer having a pump for injecting air or other gases into the vortex ring for aerating the fluid.

FIG. 9 shows an embodiment where enhanced mixing or agitating is achieved by using a gas such as atmospheric air injected into the generating tube by a pump 41. This results in gas or air ingestion by the vortex ring. Provided the amount or gas in the vortex ring is controlled to avoid premature destruction of the vortex ring, it will travel a reasonable distance before it self-destructs or hits a boundary. As the vortex ring translates through the liquid being mixed or agitated, gas is liberated in its wake and also when it self-destructs or hits a surface. The gas thus liberated enhances the mixing and circulation in the liquid media, and also causes considerable agitation at the liquid surface. This embodiment is particularly useful for aeration or gasification processes such as sewage treatment.

Figure 10:
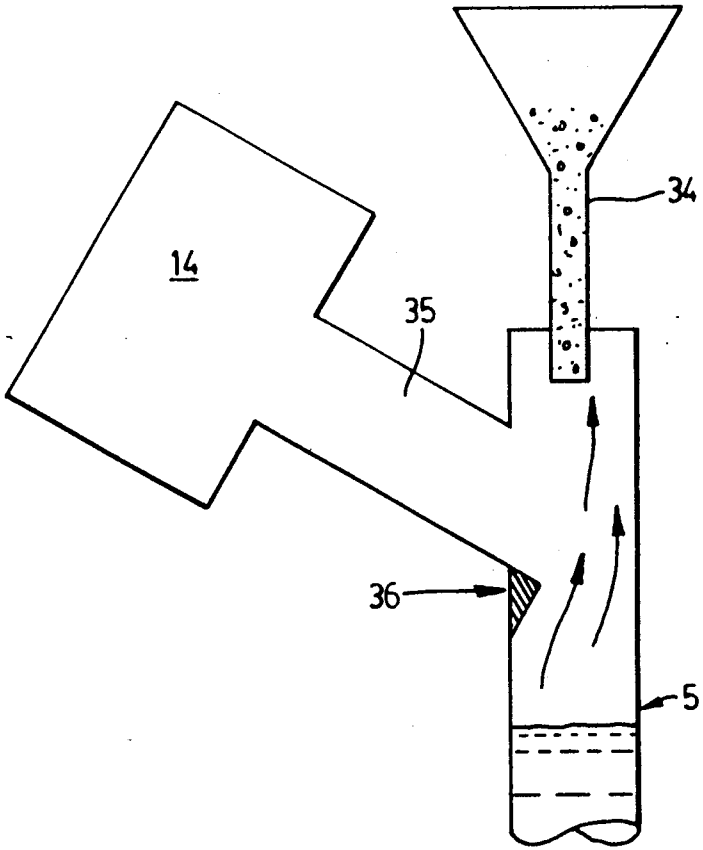
FIG. 10 is a diagram of a vortex ring mixer having a "y" branch to avoid splashing fluid from entering the pulser chamber.

FIG. 10 shows an embodiment which is used where it is undesirable to permit the liquid being mixed or agitated to enter or contact the pulser cylinder, such as where very hot liquid metals or corrosive liquids are mixed. In FIG. 10, the pulser cylinder is located on a branch tube 35, such that any splashing of liquid will go to the top of the generator tube rather than contact pulser 14. A flow deflector 36 is used to reduce the possibility of ingestion of the liquid into the pulser cylinder. Other arrangements could be used for this purpose as will be appreciated by those skilled in the art, such as baffles to shield the pulser 14, or modifying the shape of tube 5 to reduce splashing, or the addition of annular deflector rings located on the inner wall of the generator tube 5, or providing a "dog leg" in the generator tube 5.

From the above, it will be appreciated that the vortex ring mixers of the present invention are particularly suitable for large volumes of liquid, corrosive or dangerous liquids (such as liquids having viruses or bacteria in them), or very hot liquid, when the contact between the liquid and the equipment must be minimized. They use very little energy. They neither add nor extract any appreciable amounts of heat from the fluid being mixed or agitated and therefore no cooling of the liquid is necessary. They can be located such that the free surface is not appreciably disturbed. They can also be used effectively to aerate or add materials to the fluid being mixed or agitated.

It will be appreciated that the above description relates to the preferred embodiments by way of example only. Many variations on the invention will be obvious to those knowledgeable in the field, and such obvious variations are within the scope of the invention as described and claimed, whether or not expressly described.

What is claimed as the invention is:

1. Apparatus for mixing or agitating fluids, comprising:

a tube of inside diameter d having an open end, the tube being adapted to be inserted into a fluid to be mixed with the open end in the fluid; means for inserting fluid into the tube; and means for propelling a slug of fluid out of said tube; the fluid being propelled a distance L along the tube; wherein the ratio of L/d is between 0.8 and 3.8,thereby creating a vortex ring at the open end of the tube for propagation through the fluid.

2. Apparatus as claimed in claim 1, wherein the propelling means provides a generally square wave pressure impulse to the fluid in said tube.

3. Apparatus as claimed in claim 2, in which said propelling means comprises a pulser cylinder communicating with said tube and a piston positioned in said pulser cylinder for reciprocating motion towards and away from said fluid to be mixed or agitated.

4. Apparatus as claimed in claim 2, in which said propelling means comprises a bellows communicating with said tube and means for actuating said bellows to apply suction or pressure to the fluid in the tube.

5. Apparatus as claimed in claim 2 and further comprising a pipeline communicating with the tube above the fluid to be ejected therefrom, said pipeline being in communication with a supply of additive to be inserted into the fluid prior to being ejected from said open end.

6. Apparatus as claimed in claim 2 and further comprising a pipeline communicating with the tube, said pipeline being coupled to a supply of pressurized gas for injecting gas into the fluid prior to being ejected from said open end.

7. Apparatus as claimed in claim 1, wherein said fluid inserting means comprises a pipeline communicating with the tube above a desired fluid level, and a valve located in said pipeline, the valve being set such that the pressure in the tube is below ambient pressure to insert fluid into the tube, and above ambient pressure to eject fluid from the tube.

8. Apparatus as claimed in claim 1, in which said propelling means comprises a pulser cylinder communicating with said tube and a piston positioned in said pulser cylinder for reciprocating motion towards and away from said fluid to be mixed or agitated.

9. Apparatus as claimed in claim 1, in which said propelling means comprises a bellows communicating with said tube and means for actuating said bellows to apply suction or pressure to the fluid in the tube.

10. Apparatus as claimed in claim 1, in which said fluid inserting means comprises means for reciprocating said tube upwardly and downwardly in the liquid to be mixed or agitated, a valve communicating with the tube, and a valve control system for controlling said valve such that it opens when the tube is driven downwardly into the liquid, thereby allowing the gas trapped above the liquid in the tube to escape, and such that it then closes while the tube is raised, and such that it opens at a predetermined tube height to cause ejection of a slug of liquid from said tube.

11. Apparatus as claimed in claim 1 and further comprising a pipeline communicating wit the tube above the fluid to be ejected therefrom, said pipeline being in communication with a supply of additive to be inserted into the fluid prior to being ejected from said open end.

12. Apparatus as claimed in claim 1 and further comprising a pipeline communicating with the tube, said pipeline being coupled to a supply of pressurized gas for injecting gas into the fluid prior to being ejected from said open end.

13. A method of mixing a fluid comprising:

introducing a tube of inside diameter d into the fluid, said tube having an open end located in the fluid; inserting fluid into the tube;

forcing the fluid to travel a distance L through said tube and out of said open end;

wherein the ratio of L/d is between 0.8 and 3.8

14. A method of mixing a fluid as claimed in claim 13 wherein the fluid is forced through said open end by applying a square wave pressure impulse to said fluid.

15. A method of mixing a fluid as claimed in claim 13 wherein the fluid is forced through said open end by providing a cushion gas chamber communicating with the tube above the fluid therein, and rapidly pressurizing the gas in said chamber to force the fluid out of the said open end.

16. A method of mixing a fluid as claimed in claim 13 wherein fluid is forced through said open end repeatedly, the frequency of repetition being between 0.25 and 5 Hz.

17. A method of mixing a fluid as claimed in claim 13 and further comprising the step of injecting a gas into the fluid before it is forced through said open end to produce an aerated vortex ring.

18. A method of mixing a fluid as claimed in claim 13 and further comprising the step of injecting an additive into the fluid before it is forced through said open end.

* * * * *